United States Patent [19]

Longhurst et al.

[11] 4,126,865

[45] Nov. 21, 1978

[54] SATELLITE TRACKING DISH ANTENNA

[75] Inventors: David W. Longhurst, Bournemouth; Martin A. Weston, New Milton, both of England

[73] Assignee: The Secretary of State for Defence in Her Britannic Majesty's Government of the United Kingdom of Great Britain and Northern Ireland, London, England

[21] Appl. No.: 741,073

[22] Filed: Nov. 11, 1976

[30] Foreign Application Priority Data

Nov. 11, 1975 [GB] United Kingdom ..... 46604/75
Apr. 23, 1976 [GB] United Kingdom ..... 16627/76

[51] Int. Cl.[2] ..... H01Q 3/03
[52] U.S. Cl. ..... 343/766; 343/894
[58] Field of Search ..... 343/765, 766

[56] References Cited

U.S. PATENT DOCUMENTS 3,510,877 5/1970 Turriere ..... 343/765
3,530,477 9/1970 Jarrett et al. ..... 343/765
3,546,704 12/1970 Selby et al. ..... 343/765
3,945,015 3/1976 Gueguen ..... 343/765

*Primary Examiner*—Eli Lieberman
*Attorney, Agent, or Firm*—Pollock, Vande Sande and Priddy

[57] ABSTRACT

In a small satellite earth station a directional antenna is rocked about a single axis, corresponding to an oscillatory change in declination, but constant hour angle. The rocking is approximately sinusoidal and has a period of one sidereal day. In a preferred arrangement the antenna is mounted on a rocking axis pivot which is fixed at right angles to, and rotatable for adjustment about, a polar axis member. The polar axis member is set up parallel to the earth's axis and the pivot is rotated about the polar axis member to set the hour angle. The rocking of the antenna is achieved by a crank and tie-rod arrangement driven by a clock motor mounted on the polar axis member. The arrangement is particularly simple and will, when set up, track a synchronous satellite without needing frequent adjustment.

2 Claims, 5 Drawing Figures

SATELLITE TRACKING DISH ANTENNA

This invention relates to satellite earth stations, and more particularly to methods and apparatus for tracking synchronous satellites.

Synchronous satellites, as used, for example, in communication systems, are not truly geostationary. As seen from a fixed earth station they move about in the sky, and it is therefore necessary to vary the direction of antenna beams so as to follow the satellites, — a process known as "tracking." The conventional method of tracking consists of detecting when and in which direction the satellite is away from the center of the beam, and adjusting the beam direction accordingly. This method involves complex electronics and, if the beam direction is to be moved by physically moving the antenna, which is at present the usual way, an elaborate movable mounting for the antenna. For a small station, and especially for a portable one, a conventional tracking arrangement can make a considerable contribution to the complexity, bulk and cost of the station.

It is an object of the present invention to provide a comparatively simple arrangement for tracking synchronous satellites, suitable for use in small satellite earth stations; that is to say stations with antennae having diameters sufficiently small that at their working frequencies they have beam widths of about a quarter of a degree or more.

According to one aspect of the present invention there is provided a method of tracking synchronous satellites in a small satellite earth station as herein defined consisting of oscillating the direction of the beam of the antenna approximately sinusoidally with a period of one sidereal day in declination while keeping the hour angle constant.

According to another aspect of the invention there is provided satellite tracking apparatus comprising a directional antenna having a beam width of at least about a quarter of a degree, mounting means for supporting the antenna so as to allow the direction of the antenna beam to rotate about a rocking axis, the rocking axis being alignable parallel to the declination axis of a synchronous satellite, and rocking means for oscillating the direction of the beam about only the rocking axis approximately sinusoidally with a period of one sidereal day.

The expressions "declination" and "hour angle", which are currently used in the satellite tracking art are borrowed from astronomical navigation and are discussed and used, for example, by STS Lecky in 'Wrinkles' in Practical Navigation, published by George Philip and Son, 1897 (10th Edition). Some writers, such as Charles H Cotter in The Complete Nautical Astronomer, published by Hollis and Carter 1969, refer to the hour angle as the "local hour angle." They are angles specifying the direction of an observer's sight line relative to co-ordinate axes fixed relative to the earth and local to the observer. The declination axis of a body is the axis about which the sight line to the body rotates when the declination changes and the hour angle stays constant.

The apparent motion of a synchronous satellite in the sky, as seen by a fixed observer on the earth, is complex and is due to a number of factors. Firstly there is the effect of the inclination of the orbit. Synchronous satellites are deliberately placed in orbits which are inclined to the equatorial plane in order to counteract a drift towards the ecliptic. This causes a satellite to describe a thin figure-of-eight in the sky. The inclination is not constant however, but changes by about 1° per year, so the figure-of-eight slowly changes in size. In addition there is the effect of the eccentricity of the satellite's orbit, which will not be exactly circular, and there is also a drift around the equator owing to irregularities in the earth's gravitational field and inaccuracies in the satellite's altitude.

The dominant factor in determining the apparent motion of the satellite is the inclination of the orbit and the present inventors have found that for small earth stations it is sufficient to follow only the changes in declination due to the inclination of the orbit, ignoring the other effects and the changes in hour angle due to the inclination. It will be necessary to adjust the setting of the station periodically to compensate for long-term drifts in the position of the satellite and for the changes in the inclination, but in practice it has been found that such adjustments do not need to be made as frequently as might be supposed.

With the present invention the tracking arrangement is considerably simplified. Not only is the need for complex electronic tracking apparatus eliminated, but, since the required motion of the antenna beam direction is about a single axis only, the arrangements for actually moving the beam can be simplified. For example, if the antenna is to be physically moved it need only be mounted for motion about a single axis. Also, since the required motion is simple — approximately sinusoidal — it can be achieved by simple means, such as a crank and tie-rod, with a clock motor driving the crank at one revolution per sidereal day.

Although the tracking motion of the antenna beam is all about a single axis there should be provision for adjusting the position of that axis. For example, one form of mounting for an antenna, referred to in this specification as a three-axis mount, has a bearing axis member, which is in use positioned vertically, a cross-level axis member fixed at right angles to and rotatable about the bearing axis member and a rocking axis pivot, fixed at right angles to and rotatable about the cross-level axis member. The antenna is pivotally mounted about the rocking axis which can be oriented in any direction by rotation about the bearing and cross-level axis members, and then locked into position.

The three-axis mount suffers from the disadvantage that it has to be completely reset whenever the setting is to be changed either to compensate for long-term drifts of a satellite or to redirect the antenna to a different satellite. In an alternative form of mounting, referred to in this specification as an equatorial mount, there is a polar axis member, which is, in use, aligned parallel to the axis of the earth, and a rocking axis pivot fixed at right angles to and lockably rotatable about the polar axis member. To correct for long-term drifts or to acquire a different satellite it is not necessary to re-align the polar axis member, only to rotate the rocking axis pivot about the polar axis, corresponding directly to a change of hour angle, and to adjust the mean declination and the amplitude of the oscillations. The equatorial mount has the further advantage that since the declination of a satellite does not vary over a wide range the mounting does not have to allow for adjustment or motion of the antenna about the rocking axis over a wide range. A range of only about 10° is found to be adequate.

Embodiments of the invention will now be described by way of example with reference to the accompanying drawings of which:

FIG. 1 shows an antenna with tracking apparatus employing an equatorial mounting. The antenna comprises a dish 1 and a feed horn 2.

Figure 1:
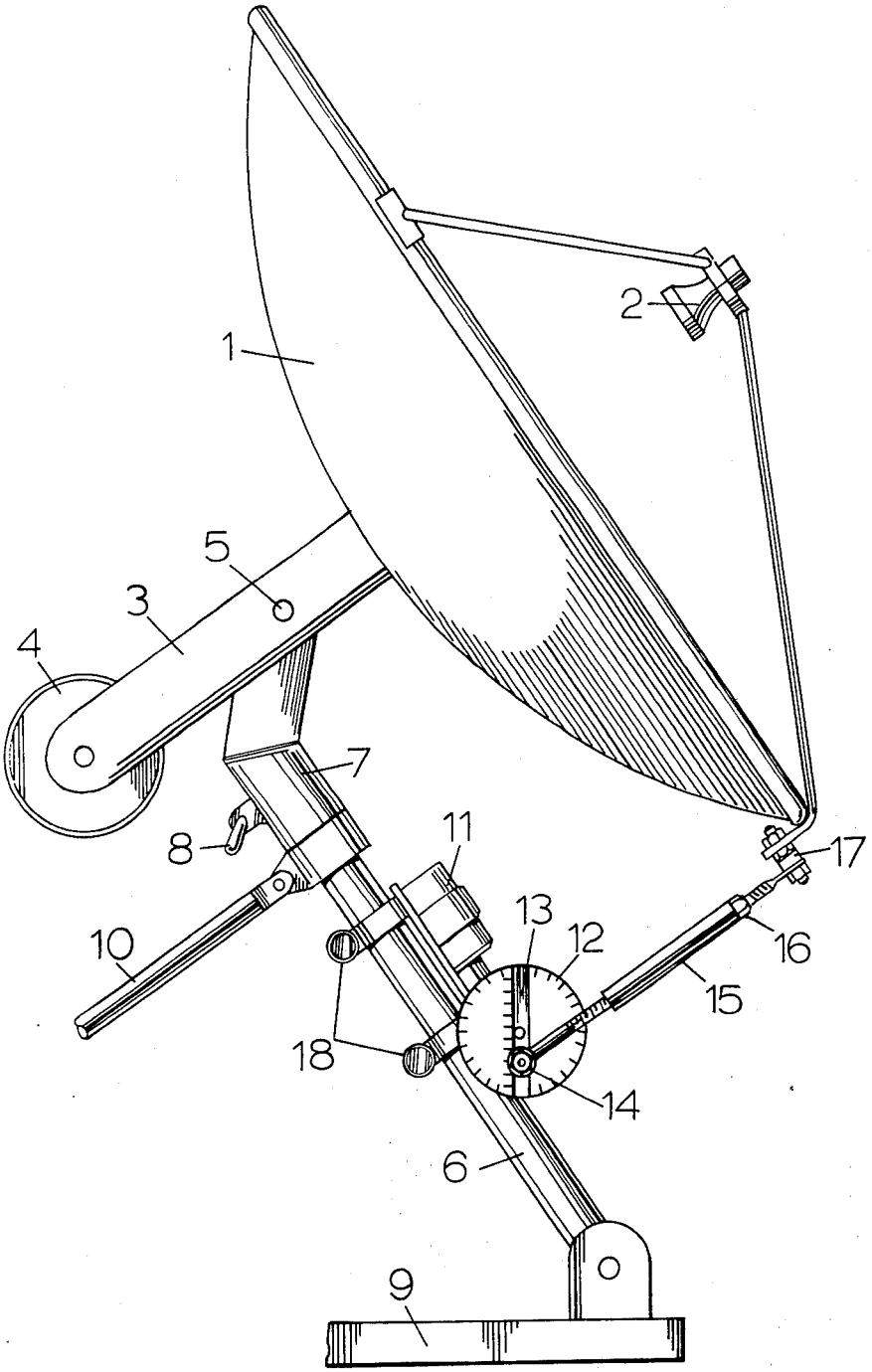
FIG. 1 shows an antenna with tracking apparatus according to the invention and having an equatorial mount.

The dish 1 is mounted on an arm 3 which carries a counterweight 4 and which is mounted on a pivot 5. The axis of the pivot 5 is, in use, aligned parallel to the declination axis of the satellite which is being tracked and forms the rocking axis. The pivot 5 is mounted on a rod 6 by means of an end member 7 which can be rotated about the longitudinal axis of the rod 6 and locked into position by means of a locking screw 8, thus providing a means for adjusting the direction of the pivot 5 while keeping it at right angles to the longitudinal axis of the rod 6, which forms the polar axis member.

The rod 6 is pivotally attached, at the end remote from the end member 7, to a base, only a part of which, 9, is shown, and is supported by a pair of struts, only a part of one of which, 10, is shown. The ends of the struts 10 remote from the rod 6 are adjustably attached to the base 9 so as to provide a means for adjusting the angle which the rod 6 makes with the base 9.

On the rod 6 is mounted an electric clock motor 11 arranged to rotate a disc 12 at the rate of one revolution per sidereal day. The assembly of motor 11 and disc 12 is fixed to the rod 6 by a mounting which is held tight by hand-screws 18. When the end member 7 is being rotated, the hand-screws 18 are loosened to allow the motor 11 and disc 12 to rotate with it. The disc 12 has a diametral re-entrant groove 13 holding a pivot member 14 which extends outwardly at right angles from the disc 12 and whose position in the groove 13 can be adjusted and then fixed by screwing tightly. A tie rod 15 whose length can be adjusted and then fixed by means of a lock nut 16 is at one end pivotally attached to the pivot member 14 and at the other end fixed by a resiliently flexible mounting 17 to a point on the perimeter of the dish 1. The tie rod 15 is constructed on the principle of, and may actually be, a rigging screw as used on sailing boats.

The antenna is set up by first adjusting the direction of the rod 6 to lie parallel with the axis of the earth, by means of the struts 10 and by suitably orienting the base 9. The hour angle is then set by rotating the end member 7 to an appropriate position and locking it in position by tightening the locking screw 8. The mean declination is then set by placing the pivot member 14 at the center of the disc 12 and adjusting the length of the tie rod 15. The amplitude of the oscillation required is then set by positioning the pivot member 14 appropriately in the groove 13, which carries graduated markings for this purpose, and the disc 12 is then rotated to a position corresponding to the time elapsed since the satellite last passed through its ascending node, for which purpose the perimeter of the disc 12 is graduated in hours. The motor 11 is then started.

Figure 2:
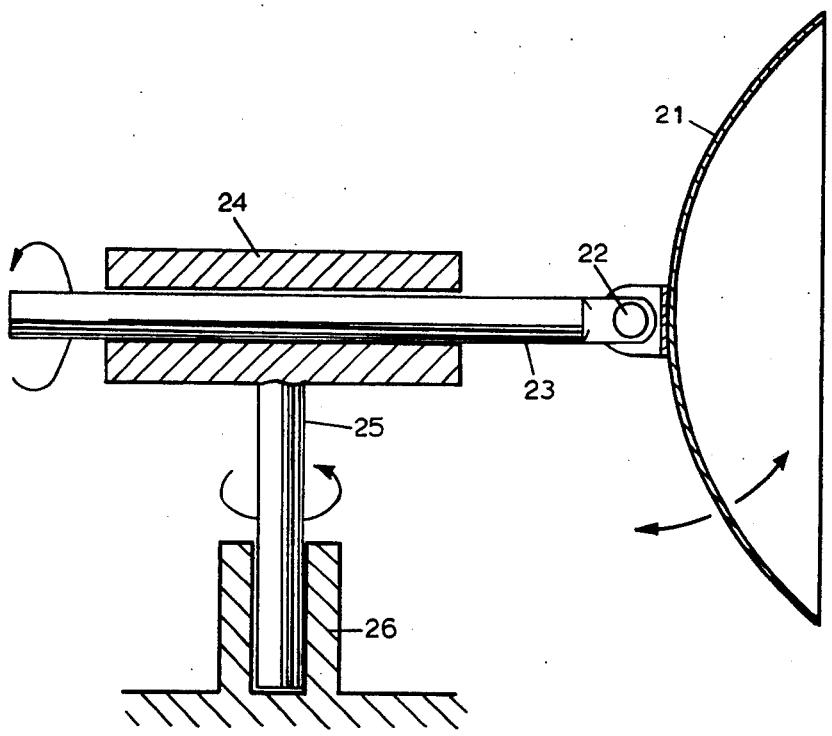
FIG. 2 shows schematically an antenna with tracking apparatus according to the invention and having a three-axis mount.

FIG. 2 shows schematically an antenna with a three-axis mount. A dish 21 is rotatably mounted on a pivot 22 which is rigidly fixed to a cross-level-axis rod 23, the axes of the pivot 22 and the rod 23 being perpendicular. The cross-level-axis rod 23 is held in a bearing 24 so as to be rotatable about its own axis. The bearing 24 is rigidly fixed to a bearing-axis rod 25, the axes of the bearing 24 and the rod 25 being perpendicular. The bearing-axis rod 25 is held in a bearing 26 so as to be rotatable about is own axis. Locking screws (not shown) are provided on the bearings 24 and 26 and nodding means, not shown, but similar to that shown in FIG. 1, is provided to oscillate the dish 21 about the axis of the pivot 22.

Since antenna mountings having three axes are known in connection with the stabilization of antennae on ships against ship motion it will not be necessary to describe the construction of the mounting in detail.

Figure 3:
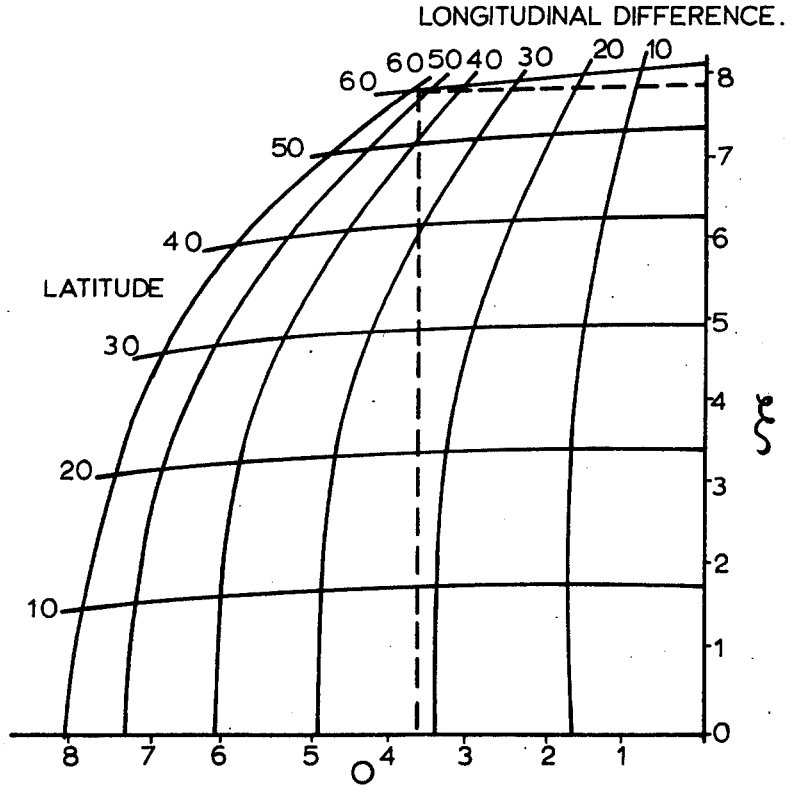
FIGS. 3 and 4, show some charts useful for setting up tracking apparatus according to the invention, and, FIG. 5 shows tracking apparatus according to the invention and having an alternative form of equatorial mount.

Although the position of a synchronous satellite oscillates about the equatorial plane, so that its mean position is on the equatorial plane, the mean declination as observed from a station on the earth's surface is not always zero, and neither is the observed hour angle simply the difference between the longitude of the point on the earth's surface immediately below the satellite and the longitude of the station. This is because the ratio between the radius of the satellite's orbit and the radius of the earth is not so large that it may be taken to be infinite for practical purposes, as is the case with the fixed stars. In fact for a synchronous orbit the ratio of the radii is about 6.6. If the difference of the longitudes is taken as a uncorrected hour angle, and zero as an uncorrected mean declination, there are thus corrections to the hour angle and declination due to the finite ratio of the radii. These corrections will always operate to make the observed position of the satellite lower in the sky than the uncorrected position. Thus, for example, if the station is in the northern hemisphere and west of the subsatellite point, the uncorrected position of the satellite will be in the south-east portion of the sky. The correction to the hour angle will mean that the observed position of the satellite is still further east than the uncorrected position and the correction to the declination means that it is still further south. The magnitudes of the corrections can be calculated simply. The correction $\Phi$ to the hour angle is given by $$\tan \phi = (\text{Sin } B \cos L/(r - \cos B \cos L)$$

and the correction $\epsilon$ to the mean declination is given by $$\sin \xi = \text{Sin } L / \sqrt{(r^2 - 2r \cos B \cos L + 1)}$$

where $r$ is the ratio of the radii, B is the difference of the longitudes and L is the latitude of the station. For practical use in setting up a station, however, it is convenient to use a chart such as that illustrated in FIG. 3, in which curves of constant latitude and curves of constant longitudinal difference are plotted relative to orthogonal rectilinear scales of the corrections to the hour angle and the declination. To use the chart, one finds the point corresponding to the appropriate longitudinal difference and latitude and reads off the corresponding corrections from the orthogonal scales. The dotted lines in FIG. 3 indicate how one would find the corrections if the longitudinal difference was 55° and the latitude 60°. The correction to the hour angle would be about 3°40′ and the correction to the mean declination about 7°50′.

Figure 4:
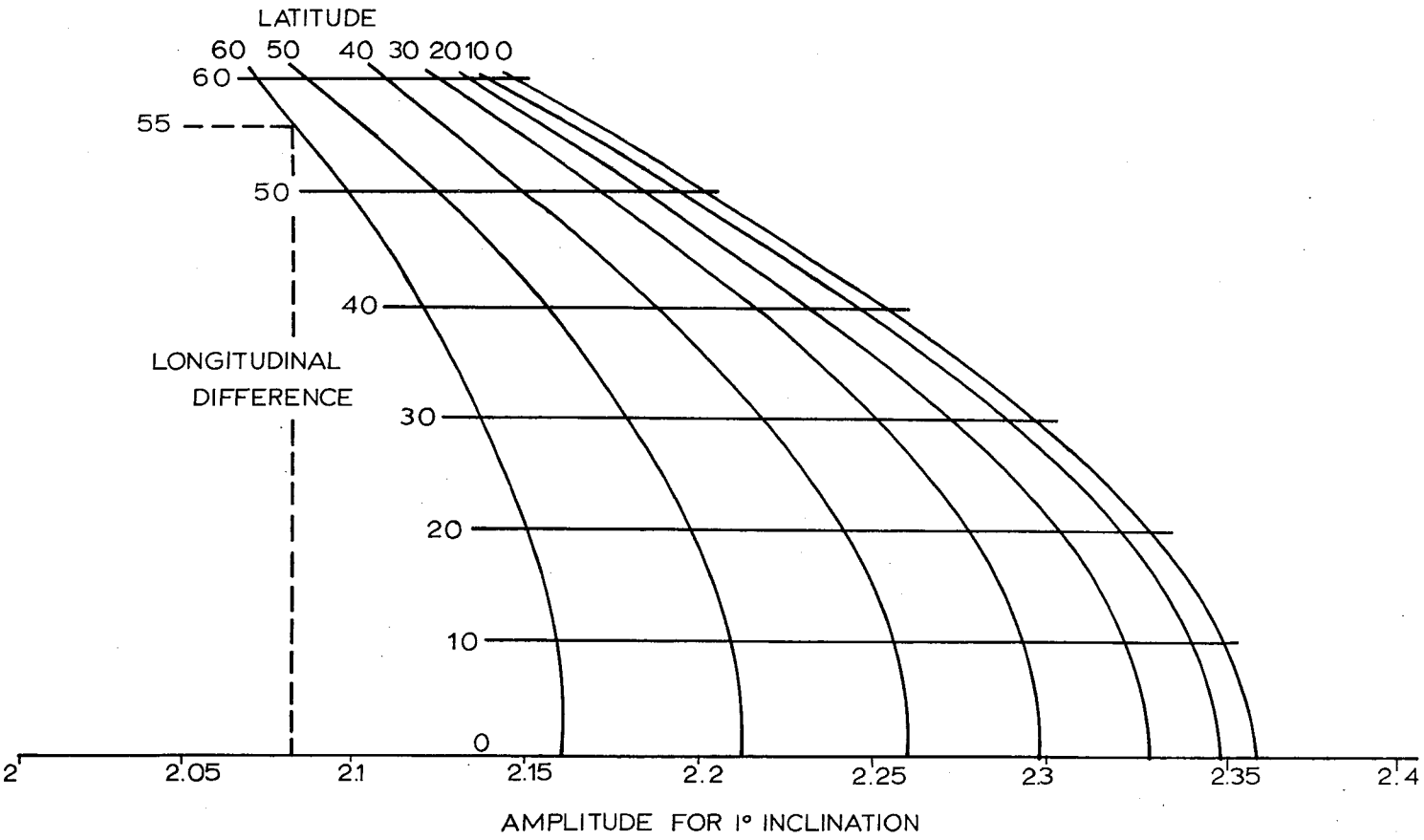

As well as corrections to the hour angle and the mean declination there will be a correction to the amplitude of the observed oscillation of the position of the satellite. If the ratio $r$ were infinite the amplitude, which in this specification means the subtended angle between the extreme points of the satellite's apparent motion, would simply be twice the inclination of the orbit. The finite value of $r$ has the effect of increasing the amplitude. Since for the values of the inclinations of orbits used for synchronous satellites (not greater than about 3° as a rule) the amplitude is practically proportional to the inclination, it is convenient to calculate values of the amplitude for an inclination of 1°. FIG. 4 shows a chart for finding such values corresponding to given values of latitude and longitudinal difference. The dotted line indicates how one would use the chart to find the amplitude if the longitudinal difference was 55° and the latitude 60°. The amplitude for an inclination of one degree is about 2.08°, so if the inclination is, say, 2.5°, the amplitude will be $2.5 \times 2.08 = 5.2°$.

Figure 5:
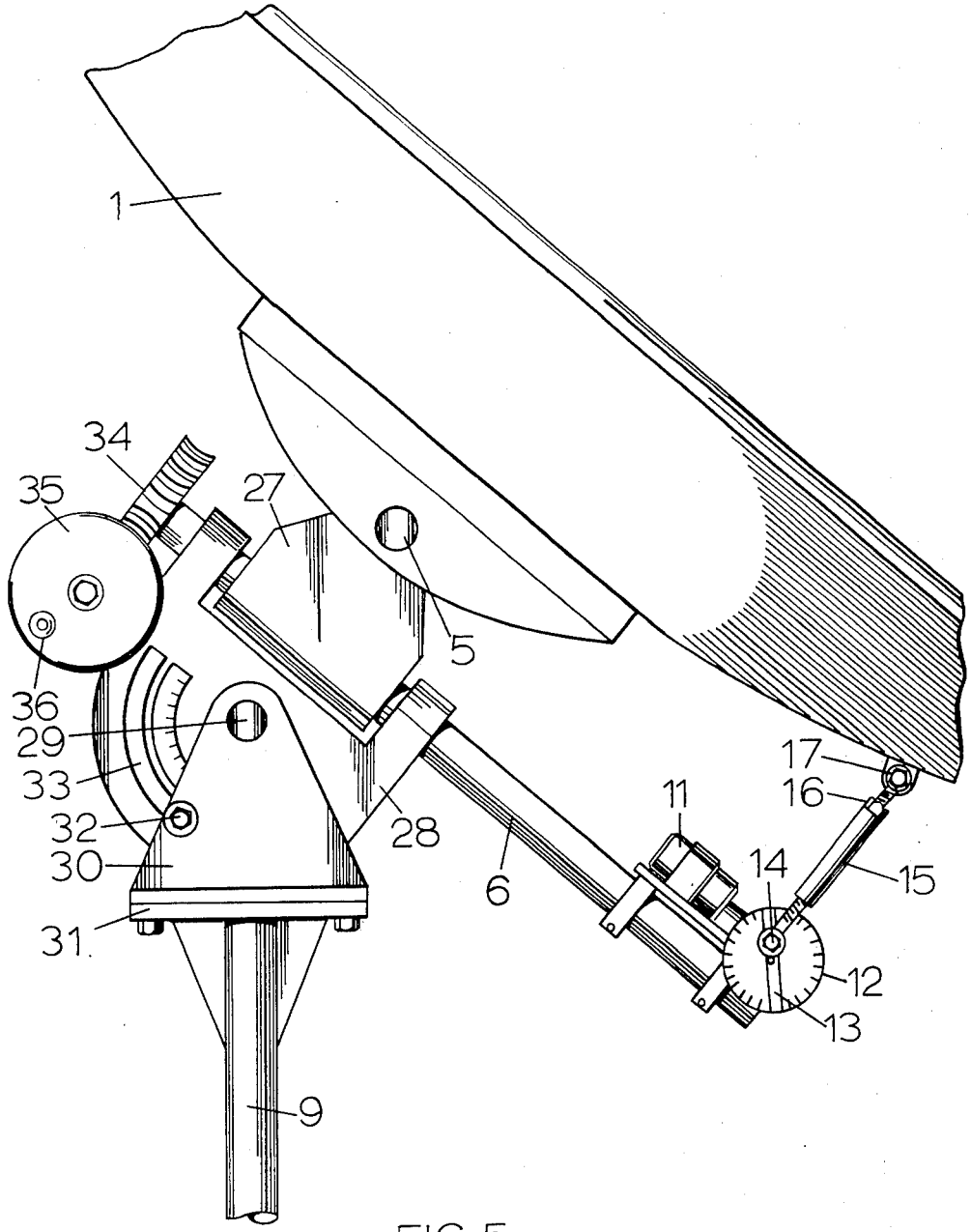

FIG. 5 shows part of a dish 1 of an antenna mounted on a pivot 5 which is fixed to a first hinge member 27. The first hinge member 27, together with a second hinge member 28 and a rod 6, form a hinge, with the rod 6, which is rigidly fixed to the first hinge member 27 and journalled in the second hinge member 28, forming the hinge-pin. The axis of the pivot 5 is at right angles to the axis of the rod 6 and forms the rocking axis. The second hinge member 28 is mounted on a pivot 29, whose axis is at right angles to the axis of the rod 6, between trunnions 30 which are bolted onto a table 31 at the head of a pillar 9 which forms part of the supporting structure (not shown). The axis of the pivot 29 is, in use, aligned in a horizontal east-west direction so that the second hinge member 28 and the rod 6 are constrained to rotate in the plane of the meridian of the tracking station. The rod 6 is, in use, aligned parallel to the axis of the earth and for this purpose the second hinge member 28 carries an angular scale. A locking bolt 32 is provided through the trunnions 30 which, in co-operation with a part-circular aperture 33 in the second hinge member 28, can be used to lock the second hinge member in position, and hence to fix the orientation of the axis of the rod 6. The rod is the polar axis member.

A gear wheel 34 is rigidly and co-axially fixed at one end of the rod 6 and co-operates with a non-reversible worm (not visible) which is mounted on the second hinge member 28 and can be rotated manually by means of a disc 35 carrying a handle 36. The rod 6, and with it the first hinge member 27, the pivot 5 and the dish 1, can thus be rotated about the axis of the rod 6 to set the hour angle at which the antenna is set.

Towards the other end of the rod 6 is a clock motor and disc assembly 11 to 14 connected to a mounting 17 on the dish 1 by a tie-rod 15 having a lock-nut 16, similar to the corresponding parts described with reference to FIG. 1, the differences being that the mounting 17 is attached to the dish 1 at a point intermediate between the perimeter and the center of the dish, and the disc 12 is thus smaller, and, since the rod 6 rotates with the dish 1 as the hour angle is changed, the clock motor and disc assembly 11 to 14 is fixed rigidly to the rod 6 without any need for the hand screws 18 (FIG. 1).

Several variations to the embodiments described will be apparent to a person skilled in the relevant art, for example instead of oscillating the whole antenna the dish could be kept stationary and the feed horn oscillated.

We claim:

1. Satellite tracking apparatus for tracking a synchronous satellite comprising a directional antenna having a beam width of at least about a quarter of a degree, mounting means for supporting said antenna so as to constrain rotation of the direction of said antenna beam about a single rocking axis only, means for aligning said rocking axis parallel to the declination axis of the synchronous satellite and for fixing said axis in said aligned position, and rocking means for oscillating the direction of said beam about said single rocking axis approximately sinusoidally with a period of one sidereal day to follow only the changes in declination due to the inclination of the orbit of the satellite, said rocking means comprising a crank, a clock motor adapted to rotate said crank at a rate of one revolution per sidereal day, and a tie-rod connecting said crank and said antenna to impart oscillatory motion about said rocking axis to said antenna beam.

2. Apparatus as claimed in claim 1 wherein said crank has an adjustable throw and wherein said tie-rod is of adjustable length and connects said crank to a point fixed on said antenna.

* * * * *